US012546514B2

(12) United States Patent
Wang et al.

(10) Patent No.: US 12,546,514 B2
(45) Date of Patent: Feb. 10, 2026

(54) REFRIGERATION SYSTEM

(71) Applicant: Carrier Corporation, Palm Beach Gardens, FL (US)

(72) Inventors: Qin Wang, Shanghai (CN); Haijun Li, Shanghai (CN); Jin Liu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 96 days.

(21) Appl. No.: 18/406,474

(22) Filed: Jan. 8, 2024

(65) Prior Publication Data

US 2024/0230172 A1 Jul. 11, 2024

(30) Foreign Application Priority Data

Jan. 9, 2023 (CN) ..... 202320060215.7

(51) Int. Cl.
*F25B 25/00* (2006.01)
*F25B 41/20* (2021.01)

(52) U.S. Cl.
CPC ..... *F25B 25/005* (2013.01); *F25B 41/20* (2021.01)

(58) Field of Classification Search
CPC ..... Y02B 30/70; F25B 49/02; F25B 41/00; F25B 41/20; F25B 25/005
See application file for complete search history.

(56) References Cited

U.S. PATENT DOCUMENTS 7,185,501 B2 * 3/2007 Steinbach ..... F25D 16/00 62/434
10,041,708 B2 8/2018 Sedlak et al.
10,718,553 B2 7/2020 Douven et al.
11,022,349 B2 6/2021 Perrotin
11,175,076 B2 11/2021 Kopko et al.
11,359,847 B2 * 6/2022 Kopko ..... F25B 23/006
11,408,621 B2 8/2022 Kirkman et al.
11,448,429 B2 9/2022 Chamoun
11,506,406 B2 11/2022 Grabon
(Continued)

FOREIGN PATENT DOCUMENTS

CN 101769396 B 5/2012
CN 104048434 B 6/2018
(Continued)

OTHER PUBLICATIONS

Extended European Search Report received for EP Application No. 24151042.9, mailed on May 28, 2024, 7 Pages.

*Primary Examiner* — Ana M Vazquez
(74) *Attorney, Agent, or Firm* — Drew Folgmann

(57) ABSTRACT

Described herein is a refrigeration system that includes a first circuit, second circuit, and a coolant circuit. The first circuit is a natural cooling circuit and the second circuit is a mechanical refrigeration circuit. The first circuit includes a first evaporator and the second circuit includes a second evaporator. The coolant circuit passes through the first evaporator and the second evaporator in sequence. The coolant circuit includes a first bypass branch in parallel with the first evaporator, where a first control valve is provided on the first bypass branch. The refrigeration system has a smaller flow resistance in the mechanical refrigeration mode, thus effectively reducing the energy consumption of a coolant drive pump on the coolant flow path.

20 Claims, 2 Drawing Sheets

(56) References Cited

U.S. PATENT DOCUMENTS

| | | | | |
|---|---|---|---|---|
| 2014/0260376 | A1 | 9/2014 | Kopko et al. | |
| 2016/0363359 | A1* | 12/2016 | Lin | F25B 41/20 |
| 2021/0262714 | A1* | 8/2021 | Hikone | F25B 49/02 |
| 2022/0307748 | A1 | 9/2022 | Jovet et al. | |
| 2022/0364776 | A1 | 11/2022 | Kopko et al. | |

FOREIGN PATENT DOCUMENTS

| | | | | |
|---|---|---|---|---|
| CN | 106032919 | B | 9/2019 | |
| CN | 108700347 | B | 2/2021 | |
| CN | 110325804 | B | 8/2021 | |
| CN | 115362340 | A | 11/2022 | |
| EP | 3430327 | A1 | 1/2019 | |
| WO | WO-2024206838 | A1 * | 10/2024 | F25B 25/005 |

* cited by examiner

REFRIGERATION SYSTEM

CROSS REFERENCE TO RELATED APPLICATION

This application claims priority to Chinese Patent Application No. 202320060215.7 filed on Jan. 9, 2023, which is incorporated by reference herein in its entirety.

FIELD OF THE INVENTION

The invention relates to a refrigeration system, and in particular to a refrigeration system for data center cooling.

BACKGROUND OF THE INVENTION

For data center cooling, a refrigeration system using a mechanical refrigeration module and a natural cooling module adopts a mixed refrigeration mode. The natural cooling system is used when the ambient temperature is relatively low, the mechanical refrigeration system is used when the ambient temperature is relatively high, and both are used simultaneously when the ambient temperature is moderate. The coolant exchanges heat with the natural cooling module and the mechanical refrigeration module in sequence, and is used for cooling of the load.

SUMMARY OF THE INVENTION

According to one aspect, a refrigeration system is provided, comprising:

- a first circuit, wherein the first circuit is a natural cooling circuit and comprises a first evaporator;
- a second circuit, wherein the second circuit is a mechanical refrigeration circuit and comprises a second evaporator; and
- a coolant circuit, wherein the coolant circuit passes through the first evaporator and the second evaporator in sequence, and the coolant circuit further comprises a first bypass branch in parallel with the first evaporator, where a first control valve is provided on the first bypass branch.

Optionally, in an embodiment of the refrigeration system, the first circuit comprises a drive pump, a first condenser, and the first evaporator.

Optionally, in an embodiment of the refrigeration system, the fluid in the first circuit is antifreeze, wherein the antifreeze comprises ethylene glycol or propylene glycol.

Optionally, in an embodiment of the refrigeration system, the first evaporator is a plate heat exchanger.

Optionally, in an embodiment of the refrigeration system, the second circuit comprises a compressor, a second condenser, a second throttling device, and the second evaporator.

Optionally, in an embodiment of the refrigeration system, the second evaporator is a flooded evaporator or a falling film evaporator.

Optionally, in an embodiment of the refrigeration system, the first circuit comprises a first condenser, the second circuit comprises a second condenser, where the first condenser and the second condenser are integrated into one outdoor unit and share a fan unit.

Optionally, in an embodiment of the refrigeration system, the first bypass branch is connected between a coolant inlet and a coolant outlet of the first evaporator.

Optionally, in an embodiment of the refrigeration system, the refrigeration system is configured to operate in a first mode in which only the first circuit operates, a second mode in which only the second circuit operates, and a third mode in which the first circuit and the second circuit both operate.

Optionally, in an embodiment of the refrigeration system, the first control valve is closed in the first mode and the third mode, and opened in the second mode.

Optionally, in an embodiment of the refrigeration system, the coolant circuit further comprises a second bypass branch in parallel with the second evaporator, where a second control valve is provided on the second bypass branch.

Optionally, in an embodiment of the refrigeration system, the second control valve is closed in the second mode and the third mode, and opened in the first mode.

Optionally, in an embodiment of the refrigeration system, the second bypass branch is connected between a coolant inlet and a coolant outlet of the second evaporator.

Optionally, in an embodiment of the refrigeration system, the coolant circuit further comprises a coolant drive pump and a load.

The refrigeration system according to the embodiments of the invention has a smaller flow resistance in the mechanical refrigeration mode, thus effectively reducing the energy consumption of the coolant drive pump in the coolant circuit.

BRIEF DESCRIPTION OF THE DRAWINGS

With reference to the accompanying drawings, the disclosure of the invention will become easier to understand. Those skilled in the art will easily understand that these drawings are for the purpose of illustration, and are not intended to limit the protection scope of the invention. In addition, in the figures, similar numerals are used to denote similar components, where.

DETAILED DESCRIPTION OF EMBODIMENT(S) OF THE INVENTION

It is easy to understand that according to the technical solution of the invention, without changing the essence of the invention, those skilled in the art can propose multiple interchangeable structures and embodiments. Therefore, the following specific embodiments and drawings are only exemplary explanations of the technical solution of the invention and should not be regarded as the entirety of the invention or as limitations or restrictions on the technical solution of the invention.

The orientation terms mentioned or possibly mentioned in the specification, such as up, down, left, right, front, back, front side, back side, top, bottom, etc., are defined relative to the structures shown in the accompanying drawings. They are relative concepts and may vary accordingly depending on their different positions and states of use. Therefore, these or other orientation terms should not be interpreted as restrictive terms.

Figure 1:
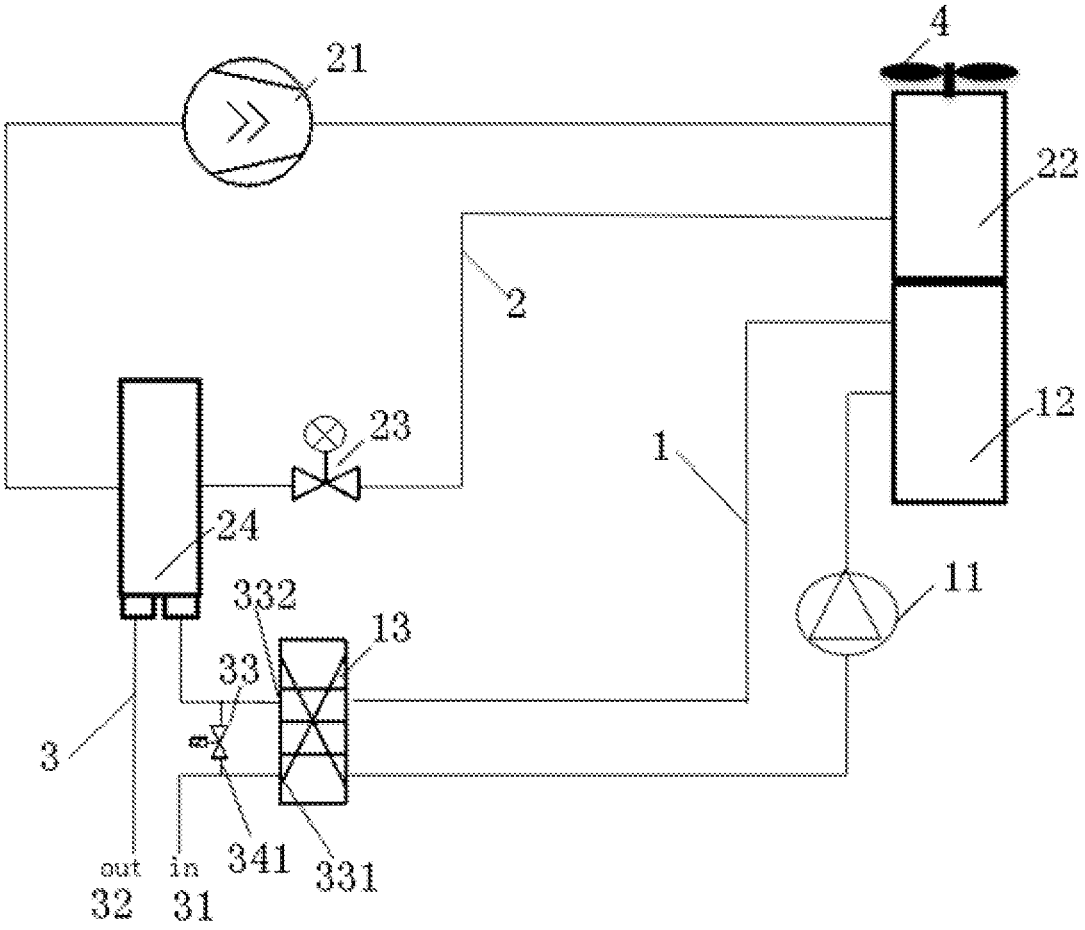
FIG. 1 shows a schematic diagram of a refrigeration system according to an embodiment of the invention.

Referring first to FIG. 1, a refrigeration system according to an embodiment of the invention is illustrated. The refrigeration system according to the embodiment of the invention comprises: a first circuit 1 comprising a first evaporator 13, a second circuit 2 comprising a second evaporator 24, and a coolant circuit 3. Although not shown, the coolant circuit 3 comprises one or more loads, such as a data center server to be cooled.

In some embodiments, the first circuit 1 is a natural cooling circuit, in which antifreeze may be used, where the antifreeze may include ethylene glycol, propylene glycol, or other suitable types of fluid. In some embodiments, the first circuit 1 comprises a drive pump 11, a first condenser 12, and a first evaporator 13. The fluid in the first circuit 1 exchanges heat with the environment (air) at the first condenser 12 and provides cooling capacity to the coolant in the coolant circuit 3 at the first evaporator 13. In some embodiments, the first condenser 12 may be a circular tube plate fin heat exchanger.

In some embodiments, the second circuit 2 is a mechanical refrigeration circuit, which may include a compressor 21, a second condenser 22, a throttling device 23, and a second evaporator 24. Conventional refrigerant such as R22 or R-134a circulates in the second circuit 2 and transfers the cooling capacity to the coolant in the coolant circuit 3 at the second evaporator 24. In some embodiments, the first condenser 12 and the second condenser 22 of the refrigeration system can be integrated together, for example, integrated into the same outdoor unit. Besides, the first condenser 12 and the second condenser 22 can share the same fan unit 4, thereby facilitating the installation of the system.

The coolant circuit 3 passes through the first evaporator 13 and the second evaporator 24 in sequence. In other words, the first evaporator 13 and the second evaporator 24 are connected in series in the coolant circuit 3, so that the coolant can exchange heat with the fluid in the first circuit 1 and the second circuit 2, respectively. Coolant commonly used in the refrigerant circuit 3 is, for example, water or salt water. Although not shown in the figure, the coolant circuit 3 also includes a coolant drive pump and one or more loads. In addition, the coolant circuit 3 further includes a first bypass branch 341 in parallel with the first evaporator 13. A first control valve 33 is provided on the first bypass branch 341, where the first control valve 33 is used to control the on and off of the first bypass branch 341. For example, the first control valve 33 can be an electric water valve or other suitable type of valve that can be electrically controlled to connect or cut the first bypass branch 341. In some embodiments, the first bypass branch 341 can be directly connected between the coolant inlet 331 and the coolant outlet 332 of the first evaporator 13.

FIG. 1 only illustrates a portion of the coolant circuit 3, namely the portion between the inlet port 31 and the outlet port 32. As a matter of fact, the coolant circuit 3 also includes a coolant drive pump that drives the coolant to circulate in the coolant circuit 3 and one or more loads to be cooled, such as data center servers. Specifically, the refrigeration system shown is commonly used in scenarios where cooling is required all year round, such as data centers, and the refrigeration system can operate in multiple modes.

In some embodiments, when the ambient temperature is relatively low, such as in winter or at night, the refrigeration system can operate in a first mode in which only the first circuit 1 operates. At this point, the compressor 21 in the second circuit can be turned off, and the drive pump 11 in the first circuit is turned on, where the first circuit 1 alone can meet the refrigeration demand of the load. When the ambient temperature is relatively high, such as in summer or daytime, since the second condenser 12 may not be able to effectively dissipate heat to the environment, the refrigeration system can operate in a second mode in which only the second circuit 2 operates. At this point, the compressor 21 in the second circuit can be turned on, and the drive pump 11 in the first circuit is turned off. In addition, when the ambient temperature is moderate, such as in spring and autumn, the refrigeration system can operate in a third mode in which the first circuit 1 and the second circuit 2 both operate. In the third mode, the drive pump 11 and the compressor 21 are both turned on, while the coolant exchanges heat and is cooled in the first evaporator 13 and the second evaporator 24 in sequence. The refrigeration system can be configured with control devices to control the operating modes of the refrigeration system based on ambient temperature and other factors.

In the refrigeration system, especially when the first evaporator 13 is a plate heat exchanger, it may have a relatively large flow resistance, which causes the energy consumption of the drive pump in the coolant circuit 3 to increase, especially in the second mode when the first circuit is not in operation. Therefore, a first bypass branch 341 is provided, on which a first control valve 33 is arranged, so that the first evaporator 13 is bypassed when the first circuit 1 is not in operation. In some embodiments, the first control valve 33 is closed in the first mode and the third mode, and opened in the second mode, so that all the coolant passes through the first evaporator 13 in the first mode and the third mode, while most of the coolant passes through the bypass branch 341 without passing through the first evaporator 13 in the second mode. In some embodiments, in the second mode, the bypass branch 341 is configured so that at least 60% of the coolant passes through the bypass branch 341 without passing through the first evaporator 13. Optionally, in the second mode, at least 70% of the coolant passes through the bypass branch 341. Optionally, in the second mode, at least 80% of the coolant passes through the bypass branch 341. Optionally, in the second mode, at least 90% of the coolant passes through the bypass branch 341. It should be appreciated that although the flow resistance of the first evaporator 13 is relatively large, there will still be a portion of the coolant passing through it. By allowing most of the coolant to pass through the first bypass branch 341, the flow resistance of the coolant circuit 3 in the second mode is greatly lowered, thereby reducing the energy consumption of the coolant drive pump on the coolant circuit 3. Under some working conditions, such as in areas with warm climate all year round, in order to meet the cooling demand of the data center, i.e., water inlet temperature 18° C. and water outlet temperature 12° C., the refrigeration system operating under the second mode counts 50% or more of all working conditions in a year. By arranging the first bypass branch 341 and the first control valve 33, the energy consumption of the coolant drive pump on the coolant circuit 3 can be reduced by more than 20%.

Figure 2:
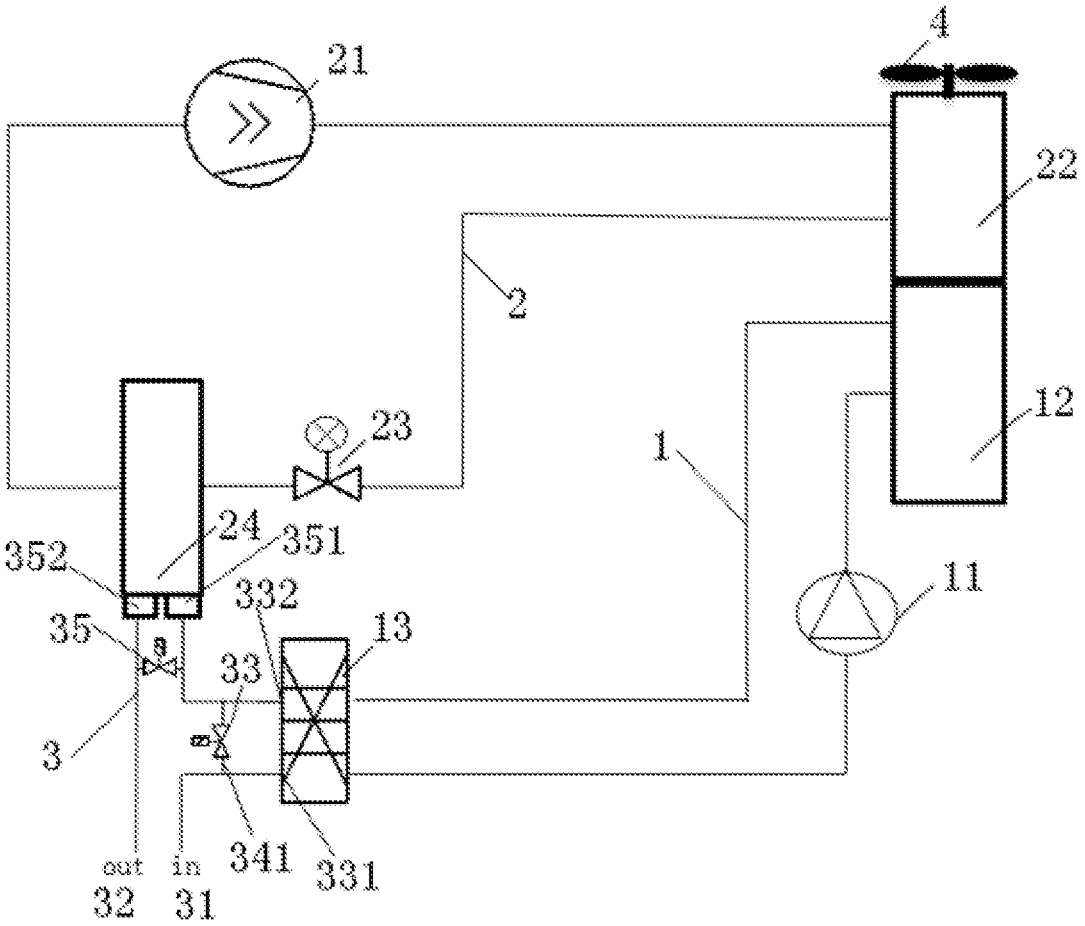
FIG. 2 shows a schematic diagram of a refrigeration system according to another embodiment of the invention.

With continued reference to FIG. 2, a refrigeration system according to an alternative embodiment is shown. As to the refrigeration system according to the embodiment of FIG. 2, its operating concept is basically the same as that of the refrigeration system shown in FIG. 1, except that a second bypass branch in parallel with the second evaporator 24 is further provided in the system, and a second control valve 35 is arranged on the second bypass branch. In some embodiments, the refrigeration system is configured to allow the second control valve 35 to be closed in the second mode and the third mode, and to be opened in the first mode, so that most of the coolant does not pass through the second evaporator 24 in the first mode, thereby reducing the energy consumption of the coolant drive pump in the first mode. In some embodiments, the second bypass branch may be directly connected between the coolant inlet 351 and the coolant outlet 352 of the second evaporator. Of course, in some embodiments, in the case where the second evaporator 24 is a flooded evaporator or a falling film evaporator, a second bypass branch and a second control valve may not be provided, as the flow resistance of the second evaporator 24 is relatively small in this case. In some embodiments, the first bypass branch and the first control valve, as well as the second bypass branch and the second control valve, can be selected to be configured based on the specific application environment of the refrigeration system, such as geographical location, annual temperature curve, and the like.

The refrigeration system according to the embodiments of the invention has a smaller flow resistance in the mechanical refrigeration mode, thus effectively reducing the energy consumption of the coolant driving pump in the coolant circuit.

The specific embodiments described above in the invention are merely intended to describe the principles of the invention more clearly, wherein various components are clearly shown or described to facilitate the understanding of the principles of the invention. Those skilled in the art may without departing from the scope of the invention, make various modifications or changes to the invention. Therefore, it should be understood that these modifications or changes should be included within the scope of patent protection of the invention.

What is claimed is:

1. A refrigeration system, comprising:

a first circuit, wherein the first circuit is a natural cooling circuit and comprises a first evaporator;

a second circuit, wherein the second circuit is a mechanical refrigeration circuit and comprises a second evaporator; and a coolant circuit, wherein the coolant circuit passes through the first evaporator and the second evaporator in sequence, and the coolant circuit further comprises a first bypass branch connected in parallel with the first evaporator, the first bypass branch having a first end directly connected to an inlet of the first evaporator and a second end directly connected to an outlet of the first evaporator, and wherein a first control valve is provided between the first end and the second end on the first bypass branch.

2. The refrigeration system according to claim 1, wherein the first circuit comprises a drive pump, a first condenser, and the first evaporator, where fluid in the first circuit is antifreeze comprising ethylene glycol or propylene glycol.

3. The refrigeration system according to claim 2, wherein the first evaporator is a plate heat exchanger.

4. The refrigeration system according to claim 2, wherein the first condenser is a circular tube plate fin heat exchanger.

5. The refrigeration system according to claim 1, wherein the second circuit comprises a compressor, a second condenser, a throttling device, and the second evaporator, where the second evaporator is a flooded evaporator or a falling film evaporator.

6. The refrigeration system according to claim 1, wherein the first circuit comprises a first condenser, the second circuit comprises a second condenser, where the first condenser and the second condenser are integrated into one outdoor unit and share a fan unit.

7. The refrigeration system according to claim 1, wherein the first bypass branch is connected between the inlet and the outlet of the first evaporator.

8. The refrigeration system according to claim 1, wherein the refrigeration system is configured to operate in a first mode in which only the first circuit operates, a second mode in which only the second circuit operates, and a third mode in which the first circuit and the second circuit both operate.

9. The refrigeration system according to claim 8, wherein the first control valve is closed in the first mode and the third mode, and opened in the second mode.

10. The refrigeration system according to claim 8, wherein the coolant circuit further comprises a second bypass branch in parallel with the second evaporator, where a second control valve is provided on the second bypass branch, the second control valve is closed in the second mode and the third mode, and opened in the first mode, wherein the second bypass branch is connected between a coolant inlet and a coolant outlet of the second evaporator.

11. The refrigeration system according to claim 8, wherein the coolant circuit further comprises a coolant drive pump and a load.

12. The refrigeration system according to claim 1, further comprising a control device configured to select an operating mode of the refrigeration system based on ambient temperature.

13. The refrigeration system according to claim 1, wherein in a first mode of operation of the refrigeration system, the first control valve is closed, a compressor in the second circuit is turned off, and a drive pump in the first circuit is turned on.

14. The refrigeration system according to claim 13, wherein the coolant circuit further comprises a second control valve on a second bypass branch connected in parallel with the second evaporator, and wherein in the first mode, the second control valve is open.

15. The refrigeration system according to claim 1, wherein in a second mode of operation of the refrigeration system, the first control valve is opened, a compressor in the second circuit is turned on, and a drive pump in the first circuit is turned off.

16. The refrigeration system according to claim 15, wherein in the second mode, the first bypass branch is configured to pass more than 50% of a coolant through the first bypass branch.

17. The refrigeration system according to claim 15, wherein the coolant circuit further comprises a second control valve on a second bypass branch connected in parallel with the second evaporator, and wherein in the second mode, the second control valve is closed.

18. The refrigeration system according to claim 1, wherein in a third mode of operation of the refrigeration system, the first control valve is closed, and a compressor in the second circuit and a drive pump in the first circuit are turned on.

19. The refrigeration system according to claim 18, wherein the coolant circuit further comprises a second control valve on a second bypass branch connected in parallel with the second evaporator, and wherein in the third mode, the second control valve is closed.

20. The refrigeration system according to claim 1, wherein the first control valve is a two-way bypass valve.

* * * * *